US008960286B2

(12) United States Patent
Banerjee et al.

(10) Patent No.: US 8,960,286 B2
(45) Date of Patent: Feb. 24, 2015

(54) HEAVY OIL RECOVERY USING SF6 AND RF HEATING

(75) Inventors: Dwijen K. Banerjee, Owasoo, OK (US); Tawfik N. Nasr, Katy, TX (US); Wayne R. Dreher, Jr., College Station, TX (US); Francis E. Parsche, Palm Bay, FL (US); Mark A. Trautman, Melbourne, FL (US); Victor Hernandez, Merritt Island, FL (US)

(73) Assignees: ConocoPhilips Company, Houston, TX (US); Harris Corporation, Melbourne, FL (US)

( * ) Notice: Subject to any disclaimer, the term of this patent is extended or adjusted under 35 U.S.C. 154(b) by 807 days.

(21) Appl. No.: 13/233,551

(22) Filed: Sep. 15, 2011

(65) Prior Publication Data

US 2012/0085537 A1 Apr. 12, 2012

Related U.S. Application Data

(60) Provisional application No. 61/383,078, filed on Sep. 15, 2010, provisional application No. 61/449,450, filed on Mar. 4, 2011.

(51) Int. Cl.

| | |
|---|---|
| ***E21B 43/16*** | (2006.01) |
| ***E21B 43/24*** | (2006.01) |
| ***C10G 15/08*** | (2006.01) |

(52) U.S. Cl.

CPC ..... *E21B 43/2408* (2013.01); *C10G 15/08* (2013.01); *C10G 2300/1033* (2013.01); *C10G 2300/4037* (2013.01); *C10G 2400/16* (2013.01)

USPC ..... 166/272.3; 166/401

(58) Field of Classification Search

None

See application file for complete search history.

(56) References Cited

U.S. PATENT DOCUMENTS

| | | | | |
|---|---|---|---|---|
| 2,998,523 | A * | 8/1961 | Muench et al. | 376/116 |
| 3,522,846 | A * | 8/1970 | New | 166/303 |
| 3,522,848 | A * | 8/1970 | New | 166/60 |
| 4,116,275 | A | 9/1978 | Butler et al. | |
| 4,344,485 | A | 8/1982 | Butler | |
| 4,457,365 | A * | 7/1984 | Kasevich et al. | 166/60 |
| 4,485,869 | A * | 12/1984 | Sresty et al. | 166/248 |
| 4,508,168 | A * | 4/1985 | Heeren | 166/248 |
| 4,924,701 | A * | 5/1990 | Delatorre | 73/152.52 |

(Continued)

FOREIGN PATENT DOCUMENTS

WO PCT/US11/51742 2/2012

OTHER PUBLICATIONS

Brittanic Online Encyclopedia; Dielectric Heating; 2014; p. 1 http://www.britannica.com/EBchecked/topic/162649/dielectric-heating.*

*Primary Examiner* — Angela M DiTrani
*Assistant Examiner* — Anuradha Ahuja
(74) *Attorney, Agent, or Firm* — Boulware & Valoir

(57) ABSTRACT

A method of producing heavy oil by first injecting water and sulfur hexafluoride molecules into a region. The method then introduces electromagnetic waves such as microwaves and/or radio frequencies into the region at a frequency sufficient to excite the water and the sulfur hexafluoride molecules and increase the temperature of at least a portion of the water and sulfur hexafluoride molecules within the region to produce heated water and sulfur hexafluoride molecules. At least a portion of the heavy oil is heated in the region by contact with the heated water and sulfur hexafluoride molecules to produce heated heavy oil. The heated heavy oil is then produced.

23 Claims, 1 Drawing Sheet

(56) References Cited

U.S. PATENT DOCUMENTS

| | | | | |
|---|---|---|---|---|
| 5,065,819 | A * | 11/1991 | Kasevich | 166/248 |
| 5,109,927 | A * | 5/1992 | Supernaw et al. | 166/248 |
| 6,499,536 | B1 * | 12/2002 | Ellingsen | 166/248 |
| 7,115,847 | B2 * | 10/2006 | Kinzer | 219/772 |
| 7,441,597 | B2 * | 10/2008 | Kasevich | 166/247 |
| 7,814,975 | B2 * | 10/2010 | Hagen et al. | 166/257 |
| 7,975,763 | B2 * | 7/2011 | Banerjee et al. | 166/248 |
| 2005/0179612 | A1 * | 8/2005 | Holly et al. | 343/853 |
| 2006/0102625 | A1 * | 5/2006 | Kinzer | 219/772 |
| 2006/0216940 | A1 * | 9/2006 | Gorrell et al. | 438/706 |
| 2006/0283598 | A1 * | 12/2006 | Kasevich | 166/302 |
| 2007/0261844 | A1 * | 11/2007 | Cogliandro et al. | 166/248 |
| 2008/0251454 | A1 | 10/2008 | Waibel et al. | |
| 2009/0050318 | A1 * | 2/2009 | Kasevich | 166/248 |
| 2009/0071648 | A1 * | 3/2009 | Hagen et al. | 166/272.1 |
| 2009/0194280 | A1 * | 8/2009 | Gil et al. | 166/267 |
| 2010/0012331 | A1 * | 1/2010 | Larter et al. | 166/401 |
| 2010/0078163 | A1 | 4/2010 | Banerjee et al. | |
| 2010/0219107 | A1 * | 9/2010 | Parsche | |
| 2010/0229749 | A1 * | 9/2010 | Veneruso | 102/322 |
| 2010/0276140 | A1 * | 11/2010 | Edmunds et al. | 166/272.3 |
| 2011/0120709 | A1 * | 5/2011 | Nasr et al. | 166/272.3 |

* cited by examiner

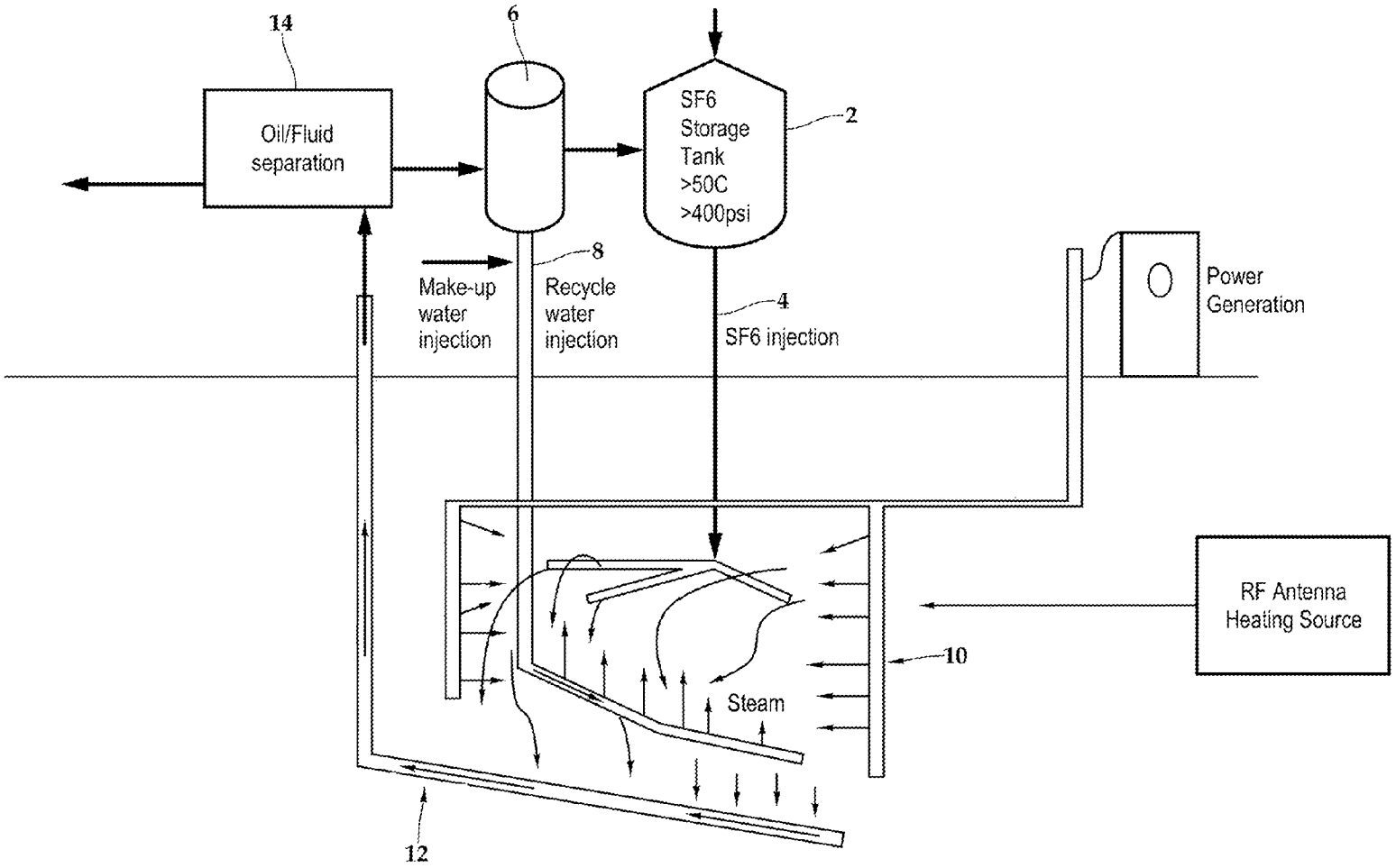
Power Generation
RF Antenna Heating Source
10
2
SF6 Storage Tank >50C >400psi
4
SF6 injection
Steam
8
Recycle water injection
6
Make-up water injection
12
14
Oil/Fluid separation

HEAVY OIL RECOVERY USING SF6 AND RF HEATING

CROSS-REFERENCE TO RELATED APPLICATIONS

This application claims priority to U.S. Provisional No. 61/383,078 filed Sep. 15, 2010, and 61/449,450, filed Mar. 4, 2011, each of which is incorporated herein in its entirety.

STATEMENT REGARDING FEDERALLY SPONSORED RESEARCH

None.

FIELD OF THE INVENTION

A method of using sulfur hexafluoride and RF frequencies to produce heavy oil.

BACKGROUND OF THE INVENTION

There are extensive deposits of viscous hydrocarbons throughout the globe, including large deposits in the Alberta tar sands and in Venezuela, which are not recoverable with traditional oil well drill and pump production technologies. The problem with producing hydrocarbons from such deposits is that the hydrocarbons are too viscous to flow at commercially viable rates at typical reservoir temperatures and pressures. In some cases, these deposits are mined using open-pit mining techniques to extract the hydrocarbon-bearing material for later processing to extract the hydrocarbons. However, many deposits cannot be mined in this way and other methods are needed.

An alternative to open-pit mining is to heat the heavy oil to reduce its viscosity until it is pumpable. A variety of thermal techniques are used to heat the reservoir fluids and rock to produce the heated, mobilized hydrocarbons from wells. One such technique for utilizing a single well for injecting heated fluids and producing hydrocarbons is described in U.S. Pat. No. 4,116,275, which also describes some of the problems associated with the production of mobilized viscous hydrocarbons from horizontal wells.

Another thermal method of recovering viscous hydrocarbons is known as steam-assisted gravity drainage (SAGD) and is currently the only commercial process that allows for the extraction of bitumen at depths too deep to be strip-mined. Various embodiments of the SAGD process are described in CA1304287 and corresponding U.S. Pat. No. 4,344,485.

In SAGD, a vertical well is drilled and connected to at least two horizontal wells that are parallel and placed some distance apart, one above the other, and near the bottom of a payzone. Steam is pumped through the upper, horizontal injection well into a viscous hydrocarbon reservoir to heat or otherwise reduce the viscosity of the heavy oil, which can then drain to the lower well for collection.

The SAGD process is believed to work as follows. The injected steam creates a "steam chamber" in the reservoir around and above the horizontal injection well. As the steam chamber expands from the injection well, viscous hydrocarbons in the reservoir are heated and mobilized, especially at the margins of the steam chamber where the steam condenses and heats a layer of viscous hydrocarbons by thermal conduction. The heated, mobilized hydrocarbons (and steam condensate) drain under the effects of gravity towards the bottom of the steam chamber, where the production well is located. The mobilized hydrocarbons are thus collected and produced from the production well.

In order to initiate a SAGD production, thermal or fluid communication must be established between an injection and a production SAGD well pair. Initially, the steam injected into the injection well of the SAGD well pair will not have any effect on the production well until at least some thermal communication is established because the hydrocarbon deposits are so viscous and have little mobility. Accordingly, a start-up phase is required for the SAGD operation. Typically, the start-up phase takes about three months before thermal communication is established between the SAGD well pair, depending on the formation lithology and the actual inter-well spacing.

The traditional approach to starting-up the SAGD process is to simultaneously operate the injection and production wells independently of one another to circulate steam. The injection and production wells are each completed with a screened (porous) casing (or liner) and an internal tubing string extending to the end of the liner, forming an annulus between the tubing string and casing. High pressure steam is simultaneously injected through the tubing string of both the injection and production wells. Fluid is simultaneously produced from each of the injection and production wells through the annulus between the tubing string and the casing. In effect, heated fluid is independently circulated in each of the injection and production wells during the start-up phase, heating the hydrocarbon formation around each well by thermal conduction.

Independent circulation of the wells is continued until efficient communication between the wells is established. In this way, an increase in the fluid transmissibility through the inter-well span between the injection and production wells is established by conductive heating. This pre-heating start up stage typically takes about three to four months. Once sufficient thermal communication is established between the injection wells, the upper, injection well is dedicated to steam injection and the lower, production well is dedicated to fluid production.

What is needed in the art are methods to improve the efficiency and cost effectiveness of the above start up process for various gravity drainage techniques.

BRIEF SUMMARY OF THE DISCLOSURE

The invention more particularly includes using sulfur hexafluoride and RF frequencies to produce heavy oil. Briefly speaking, the $SF_6$ acts as both a heavy oil solvent, effectively absorbs RF frequencies, and has a high heat conductivity and heat capacity. Additionally, $SF_6$ is a heavy gas that will settle to the bottom of the well, thus putting the solvent in direct contact with the produced oil. These various properties allow us to lower the energy needed to heat the heavy oil for production. The $SF_6$ can be used in any of the common heavy oil production techniques, and can be recycled for continued use.

BRIEF DESCRIPTION OF THE DRAWINGS

A more complete understanding of the present invention and benefits thereof may be acquired by referring to the follow description taken in conjunction with the accompanying drawings in which:

FIG. 1 depicts an embodiment of the method of using sulfur hexafluoride and microwave ("MW) and/or radio frequency ("RF") to produce heavy oil.

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment discloses a method of producing heavy oil by first injecting water and sulfur hexafluoride molecules into a region. In this embodiment the region is any formation or bitumen where heavy oil can be produced. The method then introduces electromagnetic energy, e.g., microwaves (MW) or radio frequency waves (RF), into the region at a frequency sufficient to excite the water and the sulfur hexafluoride molecules and increase the temperature of at least a portion of the water and sulfur hexafluoride molecules within the region to produce heated water and sulfur hexafluoride molecules. At least a portion of the heavy oil is heated in the region by contact with the heated water and sulfur hexafluoride molecules to produce heated heavy oil. The heated heavy oil is then produced from the region.

Sulfur hexafluoride (SF6) is an inorganic, colorless, odorless, non-toxic and non-flammable greenhouse gas. SF6 has an octahedral geometry, consisting of six fluorine atoms attached to a central sulfur atom. It is a hypervalent molecule. Typical for a nonpolar gas, it is poorly soluble in water, but soluble in nonpolar organic solvents, and thus has solvent properties for heavy oils. It is generally transported as a liquefied compressed gas and has a density of 6.12 g/L at sea level conditions, which is considerably higher than the density of air. Other properties include a thermal conductivity at STP (101.3 kPa and 0° C.) of 12.058 mW/(m·K) and a heat capacity at constant pressure (Cp) (101.3 kPa and 21° C.) of 0.097 kJ/(mol·K). These heat properties, its hydrocarbon solvent properties, heavyness, and its ability to absorb RF, make it particularly useful as a facilitator of downhole RF heating.

One of skill in the art can readily determine one or more optimal electromagnetic frequencies that activates or heats the downhole $SF_6$. For example, there is a known SF6 vibration band near 28.3 THz (10.6 um wavelength, wavenumber 948 cm-1), as well as absorbance in the infrared and ultraviolet, and simple spectrometer scanning will indicate which wavelengths are most suitable for use in energizing the SF6. Further, multiple frequencies can be used to take advantage of additional absorption peaks, or to take advantage on connate water (e.g, 2.4 or 22 GHz) or other components of the heavy oil or reservoir.

Sulfur hexafluoride has a number of uses as an electrical insulating gas. SF6 is chemically highly stable and has the ability to impede electric breakdown. Therefore, it is employed in a number of high-voltage electrical and electronic equipment such as circuit breakers, transformers, and microwave components. $SF_6$ has also been used as a tracer in storage system leak detection, for example, in the petroleum industry. However, to our knowledge it has never been used downhole as molecule injected into a formation to specifically absorb electromagnetic energy and impart heat to the formation. Thus, its use is considered quite novel.

This method can be used with a variety of enhanced oil recovery systems. Examples of enhanced oil recovery systems include: steam assisted gravity drainage, solvent assisted gravity drainage, steam drive, cyclic steam stimulation, in situ combustion or combinations and variations thereof.

In one embodiment the sulfur hexafluoride can be injected into the region in either liquid, gas, or even subcritical or supercritical fluid. Since sulfur hexafluoride is at least one hundred times more soluble in hydrocarbons when compared to water it is able to reduce the amount of water injected region over conventional steam assisted gravity drainage operations. In one embodiment the method can reduce the amount of water used by 5%, 10%, 20%, 30%, 40%, 50%, 60%, 70%, 80% even 90% of what is typically used during conventional steam assisted gravity drainage operations.

In another embodiment the method is capable of operating at temperatures much less than conventional steam assisted gravity drainage operations due to its solvent effects. In one embodiment the hydrocarbon region only needs to be heated to a temperature of 200° C. before sufficient heat transfer has occurred to the hydrocarbon fluid to promote the flow of the heavy oil.

FIG. 1 shows an embodiment of the current process. In this embodiment a method is taught for in-situ generation of steam and mobilizing heavy oil, where a combination of MW and/or RF heating and an electromagnetic absorbing sulfur hexafluoride solvent is used.

In this embodiment, tank 2 contains the sulfur hexafluoride, which can be injected downhole through a first wellbore 4. Tank 6 contains water, which can be injected downhole through a second wellbore 8. In alternate embodiments it may be possible to inject both water and sulfur hexafluoride through the same wellbore. In other embodiments, it may be better to premix the components.

In one embodiment the MW and/or RF generators 10 are disposed underground, however in alternate embodiments they can be placed above ground. As shown in FIG. 1, the MW and/or RF generators are directed towards the sulfur hexafluoride. The frequency of the MW and/or RF generators can be used to generate frequencies optimized to heat the sulfur hexafluoride.

As shown in FIG. 1, the water and sulfur hexafluoride molecules are injected above the producing wellbore for the heated heavy oil. The MW and/or RF generators 10 heat the sulfur hexafluoride molecules, which in turn heat the water molecules to produce a sulfur hexafluoride-water vapor stream. It is also possible to use multiple frequencies targeted at different components, e.g., water, SF6, and other RF absorbing components of the reservoir.

In one embodiment the temperature of the sulfur hexafluoride-water vapor stream can be around 200° C. Since the viscosity of heavy oil in the bitumen is about 20,000 cP at 100° F. and about 175 cP at 200° C., it may not be necessary to heat the reservoir to significantly above 200° F. in order to mobilize the bitumen. The use of sulfur hexafluoride as the main component in which the frequency of the MW and/or RF generators are directed to permits this increased control of the temperature. Heating is, of course, closely controlled by monitoring the temperature and adjusting the power levels on the MW or RF generator.

In one embodiment the method of producing heavy oil from a region is done without a steam generator since the heating of the water is done with the sulfur hexafluoride. To aid in the heating process, however, a steam generator can be utilized. The steam generator can be used to either pump steam downhole or to generate steam in-situ inside the region. If a steam generator is used the heated sulfur hexafluoride will supplement the heating of the water to create steam.

As the heavy oil is heated by the sulfur hexafluoride-water vapor stream the temperatures should be significantly less than what is typically found in steam assisted gravity drainage operations, due to the increased control provided by the use of sulfur hexafluoride. Oil, water and condensed sulfur-hexafluoride then enters a wellbore and produced from the third wellbore 12. During this operation the oil, water and condensed sulfur-hexafluoride can be produced at temperatures below 100° C.

In one embodiment tank 14 can be used to separate the hydrocarbons from the water and sulfur-hexafluoride. A cyclone separator or gravity drainage may be used, for example. The water and sulfur-hexafluoride can then be recycled as make-up water and make-up sulfur-hexafluoride.

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

What is claimed is:

1. A method of producing heavy oil from a subsurface reservoir:

a) injecting sulfur hexafluoride ($SF_6$) molecules into a region of a subsurface reservoir;

b) introducing microwaves or radio frequencies or both, into the subsurface reservoir at a frequency sufficient to excite the sulfur hexafluoride molecules and increase the temperature of at least a portion of sulfur hexafluoride molecules within the region to produce heated sulfur hexafluoride molecules;

c) heating at least a portion of the heavy oil in the region by contact with the heated sulfur hexafluoride molecules to produce heated heavy oil; and, d) producing the heated heavy oil.

2. The method of claim 1 wherein the microwaves or radio frequencies, or both, are generated at the surface of the subsurface reservoir and introduced into the region through at least one waveguide.

3. The method of claim 1, wherein water or steam is injected into the subsurface reservoir.

4. The method of claim 1, wherein water or steam is co-injected with the $SF_6$.

5. The method of claim 4, wherein the amount of water co-injected is about 50% less than producing the heavy oil with a steam assisted gravity drainage technique that lacks said $SF_6$ injection.

6. The method of claim 4, wherein the amount of water co-injected is about 80% less than producing the heavy oil with a steam assisted gravity drainage technique that lacks said $SF_6$ injection.

7. The method of claim 4, wherein the water and sulfur hexafluoride molecules are also produced with the heavy oil.

8. The method of claim 7, wherein the produced water and sulfur hexafluoride molecules are separated from the heated heavy oil and re-injected back into the subsurface reservoir.

9. The method of claim 4, wherein water and sulfur hexafluoride molecules are injected through a first wellbore and heated heavy oil is produced with a second wellbore.

10. The method of claim 4, wherein water and sulfur hexafluoride molecules are injected through a first horizontal wellbore and heated heavy oil is produced with a second horizontal wellbore below and parallel to said first horizontal wellbore and at or near the bottom of a payzone containing said heavy oil.

11. The method of claim 4, wherein water molecules are injected through a first wellbore, sulfur hexafluoride molecules are injected through a second wellbore and heated heavy oil is produced with a third wellbore.

12. The method of claim 4, wherein the water and sulfur hexafluoride molecules are injected above a first wellbore for producing the heated heavy oil.

13. The method of claim 1, wherein connate water is heated with the microwaves or radio frequencies, or both.

14. The method of claim 1, wherein the microwaves or radio frequencies, or both, are generated at a frequency optimized for maximum heating of the sulfur hexafluoride molecules.

15. The method of claim 1, wherein the frequencies include one or more of 2.4 GHz, and 22 GHz.

16. The method of claim 1, wherein the microwaves or radio frequencies, or both, are generated within the subsurface reservoir.

17. The method of claim 1, wherein the heavy oil is heated through dielectric heating of the sulfur hexafluoride molecules.

18. The method of claim 1, wherein the region is not heated above 200° C.

19. The method of claim 1, wherein the method of producing heavy oil is done without a steam generator.

20. The method of claim 1, further comprising e) producing heavy oil with a steam assisted gravity drainage operation.

21. The method of claim 1, further comprising e) producing heavy oil with an enhanced oil recovery method selected from the group consisting of: steam assisted gravity drainage, solvent assisted gravity drainage, steam drive, cyclic steam stimulation, in situ combustion, and combinations thereof.

22. An improved method of steam producing heavy oils comprising injecting steam into a heavy oil reservoir to heat and mobilize the heavy oils, and collecting said heated heavy oils, wherein the improvement comprises injecting both water or steam and sulfur hexafluoride ($SF_6$) into said reservoir and heating said $SF_6$ and said water or steam with an electromagnetic energy.

23. An improved method of producing heavy oils comprising heating and mobilizing a heavy oil, and collecting said heated heavy oils, wherein the improvement comprises injecting sulfur hexafluoride ($SF_6$) into said reservoir and heating said $SF_6$ with an electromagnetic energy.

* * * * *